US010123380B2

(12) United States Patent
Beer et al.

(10) Patent No.: US 10,123,380 B2
(45) Date of Patent: Nov. 6, 2018

(54) INSTANTANEOUS IN-LINE HEATING OF SAMPLES ON A MONOLITHIC MICROWAVE INTEGRATED CIRCUIT MICROFLUIDIC DEVICE

(75) Inventors: Neil Reginald Beer, Pleasanton, CA (US); Benjamin Fasenfest, Fremont, CA (US); John Chang, Danville, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 2205 days.

(21) Appl. No.: 12/433,721

(22) Filed: Apr. 30, 2009

(65) Prior Publication Data

US 2010/0089907 A1 Apr. 15, 2010

Related U.S. Application Data

(60) Provisional application No. 61/087,577, filed on Aug. 8, 2008.

(51) Int. Cl.
*H05B 6/80* (2006.01)

(52) U.S. Cl.
CPC ..... *H05B 6/806* (2013.01)

(58) Field of Classification Search
CPC .. A61M 2205/3685; A61M 2205/3686; A61M 1/369; A61M 5/44; A61M 1/36; A61M 1/0281; H05B 6/806; H05B 6/80; H05B 6/68; H05B 6/802; H05B 6/6447; H05B 6/701; H05B 6/70; G01N 1/31; G01N 1/44; G01N 1/30; A61B 18/18; A61N 5/04; C12N 1/066; C12N 13/00; C12N 1/06; G02B 6/122; G02B 6/125; G02B 6/2804; G02B 6/2817; G02B 6/32; G02B 6/423; G02B 6/12
USPC ..... 219/687; 437/7.1
See application file for complete search history.

(56) References Cited

U.S. PATENT DOCUMENTS

| | | | | |
|---|---|---|---|---|
| 6,605,454 | B2 * | 8/2003 | Barenburg et al. | 435/173.7 |
| 2002/0055167 | A1 * | 5/2002 | Pourahmadi et al. | 435/287.2 |
| 2002/0172969 | A1 | 11/2002 | Burns et al. | |
| 2003/0047688 | A1 | 3/2003 | Faris et al. | |
| 2004/0007463 | A1 | 1/2004 | Ramsey et al. | |
| 2005/0019902 | A1 | 1/2005 | Mathies et al. | |
| 2005/0042639 | A1 | 2/2005 | Knapp et al. | |
| 2005/0048581 | A1 | 3/2005 | Chiu et al. | |
| 2005/0221373 | A1 | 10/2005 | Enzelberger et al. | |
| 2005/0226779 | A1 * | 10/2005 | Oldham et al. | 422/99 |
| 2007/0151942 | A1 * | 7/2007 | Dishongh et al. | 216/13 |

(Continued)

FOREIGN PATENT DOCUMENTS

WO WO 2006069305 A2 * 6/2006 ..... H05B 6/80

*Primary Examiner* — Tu B Hoang
*Assistant Examiner* — Diallo I Duniver
(74) *Attorney, Agent, or Firm* — Eddie E. Scott

(57) ABSTRACT

A micro-electro-mechanical system for heating a sample including a substrate, a micro-channel flow channel in the substrate, a carrier fluid within the micro-channel flow channel for moving the sample in the micro-channel flow channel, and a microwave source that directs microwaves onto the sample in the micro-channel flow channel for heating the sample. The carrier fluid and the substrate are made of materials that are not appreciably heated by the microwaves. The microwave source includes conductive traces or strips and a microwave power source connected to the conductive traces or strips.

3 Claims, 19 Drawing Sheets

(56) References Cited

U.S. PATENT DOCUMENTS

| | | | | |
|---|---|---|---|---|
| 2008/0166793 | A1 | 7/2008 | Beer et al. | |
| 2009/0220968 | A1* | 9/2009 | Issadore et al. | 435/6 |

* cited by examiner

INSTANTANEOUS IN-LINE HEATING OF SAMPLES ON A MONOLITHIC MICROWAVE INTEGRATED CIRCUIT MICROFLUIDIC DEVICE

CROSS-REFERENCE TO RELATED APPLICATIONS

The present application claims benefit under 35 U.S.C. § 119(e) of U.S. Provisional Patent Application No. 61/087,577 filed on Aug. 8, 2008 entitled "method for instantaneous in-line heating and cooling of fluidic (aqueous or organic) samples on a monolithic microwave integrated circuit (MMIC) microfluidic device," the disclosure of which is hereby incorporated by reference in its entirety for all purposes.

STATEMENT AS TO RIGHTS TO INVENTIONS MADE UNDER FEDERALLY SPONSORED RESEARCH AND DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

BACKGROUND OF THE INVENTION

Field of Endeavor

The present invention relates to thermal cycling and more particularly to instantaneous in-line heating of fluidic (aqueous or organic) samples on a micro-electro-mechanical system (MEMS).

State of Technology

Microfluidic devices are revolutionizing environmental, chemical, biological, medical, and pharmaceutical detectors and diagnostics. "Microfluidic devices" loosely describes the new generation of instruments that mixes, reacts, fractionates, detects, and characterizes complex samples in a micro-electro-mechanical system (MEMS) circuits manufactured through standard semiconductor lithography techniques. These techniques allow mass production at low cost as compared to previous benchtop hardware. The applications for MEMS devices are numerous, and as diverse as they are complex. Typically these devices employ aqueous solvents as the chemical reaction medium, which may or may not be partitioned into discrete segments either as "slugs" spanning the entire channel or discrete droplets emulsified in an oil flow.

As sample volumes decrease, reagent costs plummet, reactions proceed faster and more efficiently, and device customization is more easily realized. By reducing the reactor channel dimensions, supplying the requisite activation thermal energy to drive endothermic reactions on-chip becomes much faster as heat diffusion distance decreases proportional to the channel length and the thermal mass to heat decreases on the order of length cubed. However, current MEMS fluidic systems have the problem of heating not only the chemical reactor volumes within their channels (whether they be "slugs" or emulsion droplet streams), but also heating the entire substrate which is terribly inefficient for cyclical heating reactions where the heat deposited must then be quickly removed. As the reactions proceed the substrate accumulates heat, and takes much longer to cool down.

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides a micro-electro-mechanical system for heating a sample including a substrate, a micro-channel flow channel in the substrate, a carrier fluid within the micro-channel flow channel for moving the sample in the micro-channel flow channel, and a microwave source that directs microwaves onto the sample in the micro-channel flow channel for heating the sample. The carrier fluid and the substrate are made of materials that are not appreciably heated by the microwaves. The microwave source includes conductive traces or strips and a microwave power source connected to the conductive traces or strips. In various embodiments the conductive traces or strips are copper conductive traces or strips. In other embodiments the conductive traces or strips are Indium Tin Oxide traces or Indium Tin Oxide strips.

The present invention provides a method of heating a sample including the steps of providing a substrate, providing a micro-channel flow channel operably connected to the substrate, providing a carrier fluid within the micro-channel flow channel for moving the sample in the micro-channel flow channel, and directing microwaves onto the sample in the micro-channel flow channel using a microwave source for heating the sample, the carrier fluid and said substrate being made of materials that are not appreciably heated by said microwaves.

The present invention provides a method of near-instantaneous thermal energy deposition and removal into the aqueous chemical reactor partitions or streams utilizing microwave absorption of energy from a coincident low power Co-planar waveguide (CPW) or microwave microstrip transmission line. Microwave heating of aqueous solutions exhibits excellent energy deposition due to the polarization of the water molecules. This mechanism is exploited by the ubiquitous microwave oven, and can be adapted to microscale lab-on-chip systems by innovative design and placement of microwave cavities on MEMS devices. This method provides a major improvement over current microfluidic channel heating methods such as joule-heating from trace resistors sputtered or electron-beamed onto the channel walls during device fabrication. These methods are time-consuming and provide the associated device heat build-up described above. This method not only provides the desirable cost incentive, but can cut processing times by an order of magnitude or greater, making popular on-chip processes such as Polymerase Chain Reaction (PCR), in vitro protein translation, immunoassay analysis, etc. truly real time. The benefits to bacterial, viral, chemical, explosives, and other detection, as well as point-of-care diagnostics, are obvious. Also, the burgeoning field of on-chip synthesis of chemical complexes, nanoparticles, and other novel compounds relies on precise energy deposition which is ideally suited by this method.

The present invention has use in a number of applications. For example, the present invention has use in biowarfare detection applications for identifying, detecting, and monitoring bio-threat agents that contain nucleic acid signatures, such as spores, bacteria, viruses etc. The present invention also has use in biomedical applications for tracking, identifying, and monitoring outbreaks of infectious disease including emerging, previously unidentified and genetically engineered pathogens; for automated processing, amplification, and detection of host or microbial and viral DNA or RNA in biological fluids for medical purposes; for high throughput genetic screening for drug discovery and novel therapeutics; and cell cytometry or viral cytometry in fluids drawn from clinical or veterinary patients for subsequent analysis. The present invention has use in forensic applications for automated processing, amplification, and detection of DNA in biological fluids for forensic purposes Food and Beverage Safety; for automated food testing for bacterial or viral contamination; and for water and milk supply sampling. The present invention has use in nanoparticle synthesis and microscale chemical processing for chemical processing and assembly of novel nano-structures, probes, and other endothermic reaction products of interest for manufacturing through microfluidic systems.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF SPECIFIC EMBODIMENTS

Figure 1A:
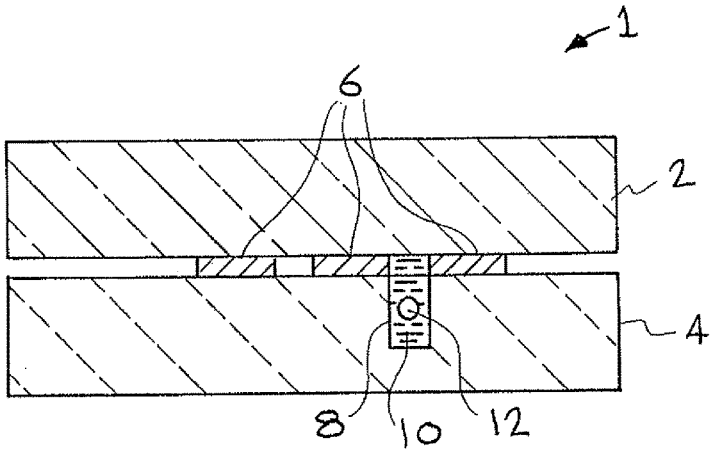
FIG. 1 illustrates one embodiment of the present invention.

Referring to the drawings, to the following detailed descriptions, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

Figure 1B:
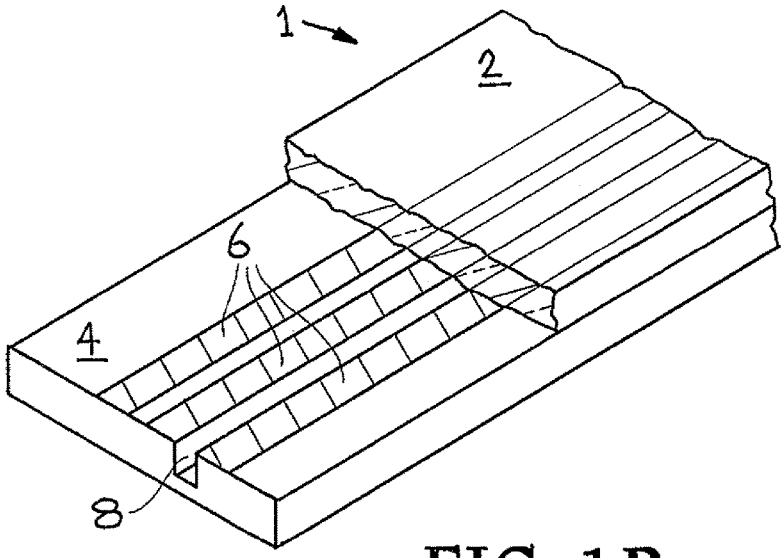
Figure 1C:
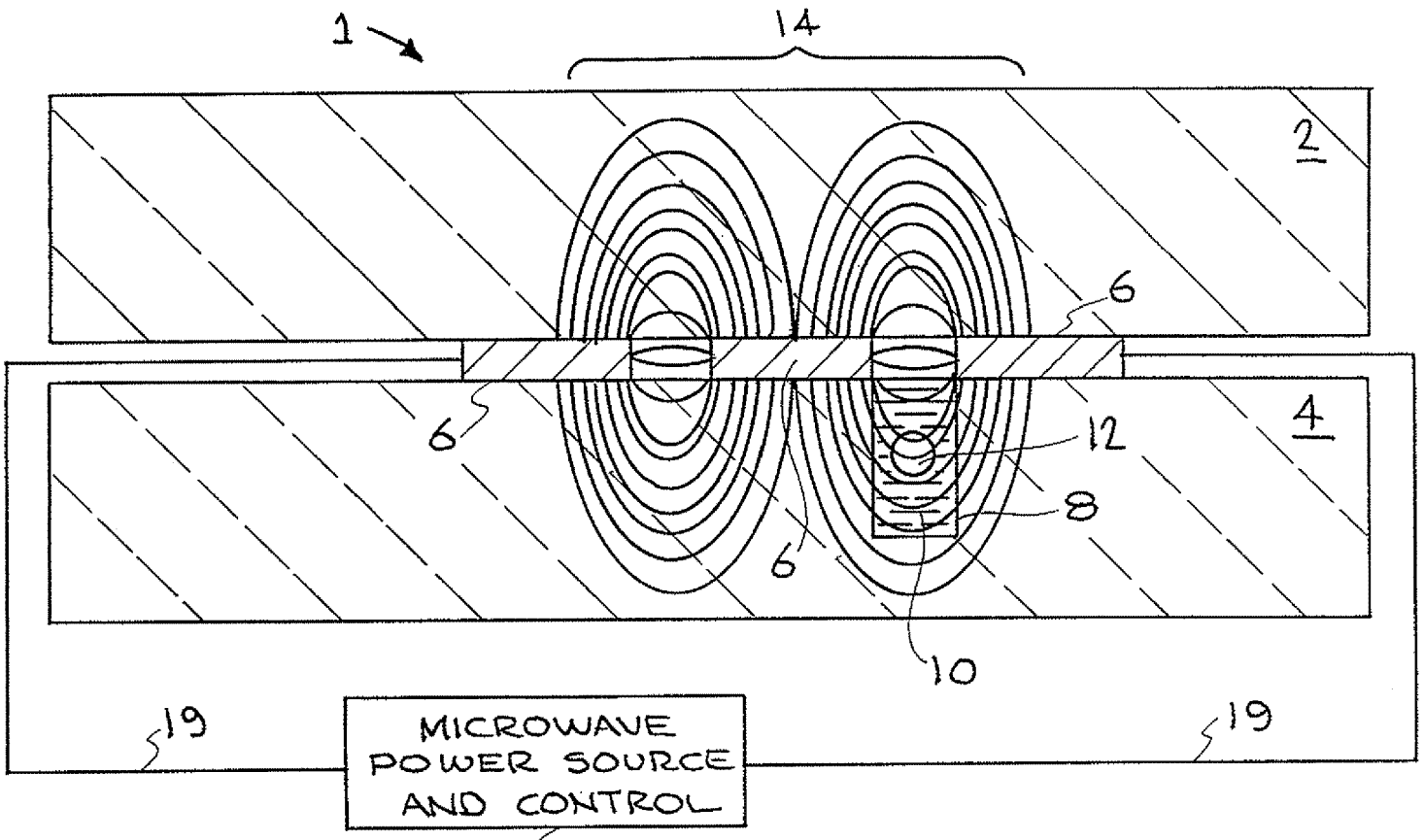

Referring now to the drawings and in particular to FIGS. 1A, 1B, and 1C; one embodiment of a system constructed in accordance with the present invention is illustrated. The system is designated generally by the reference numeral 1. The system 1 is a co-planar waveguide with a deep channel. The system 1 provides extremely rapid and efficient heating of fluidic (aqueous or organic) solutions within continuous streams or segmented micro-droplets on a micro-electro-mechanical system (MEMS) device.

Referring to FIG. 1A, the system 1 includes a silicon or glass substrate 4. A micro channel 8 is located in the silicon or glass substrate 4. The micro channel 8 is 60 μm wide and 300 μm deep. The micro channel 8 serves as a channel for oil 10 carrying a micro-droplet 12. The micro-droplet 12 contains a sample to be analyzed as will be explained subsequently. Conductive traces 6 are positioned on the silicon or glass substrate 4 proximate the micro channel 8. The conductive traces 6 are 1 μm thick copper conductive traces. A glass cover plate 2 is positioned over the silicon or glass substrate 4, the micro channel 8, and the conductive traces 6.

Referring to FIG. 1B, the micro channel 8 is shown extending along the silicon or glass substrate 4. The conductive traces 6 are positioned on the silicon or glass substrate 4 proximate the micro channel 8. The glass cover plate 2 is positioned over the silicon or glass substrate 4, the micro channel 8, and the conductive traces 6.

Referring to FIG. 1C, the three conductive traces 6 are shown connected to a microwave power source and control 17 by connectors 19. In operation the microwave power source and control 17 energizes the three conductive traces 6 producing field lines 14. The microwave power source and control 17 provides microwaves that heat the sample in the micro-droplet 12 located in the micro channel 8.

The structural details of the system 1 having been described the operation of the system 1 will now be considered. A carrier fluid source introduces the oil carrier fluid 10 into the micro-channel flow channel 8. The carrier fluid can be oil, Fluorinert, water, or other carrier fluid. The sample to be heated and/or analyzed is introduced to the micro-channel flow channel 8 by a droplet maker or other device that produces droplets or micro-reactors 12. The sample is contained within the droplets or micro-reactors 12 and can be bacterial cells, virus particles, nucleic acids, proteins, biomolecules, chemical agents, explosives agents, and other targets of interest. An example of a droplet maker is disclosed in United States Published Patent Application No. 2008/0166793 to Neil R. Beer et al for sorting, Amplification, Detection, and Identification, of Nucleic Acid Substances in a Complex Mixture published Jul. 10, 2008. The disclosure of United States Published Patent Application No. 2008/0166793 is incorporated herein in its entirety for all purposes.

The droplets or micro-reactors 12 containing the sample are carried to the heating area by the oil carrier fluid 10. The microwave source 17 transmits microwaves 14 into the microchannel flow channel 8 in the heating area. The microwave source includes the copper traces 6 that serve as electrodes and produce the microwaves 14. The microwaves 14 from the microwave source are directed to focus the microwaves 14 into the microfluidic channel 8 in the heating area. The silicon or glass substrate 4, the glass cover 2, as well as the oil carrier fluid 10 are not appreciably heated. The system 1 utilizes microwave energy absorption to instantaneously heat fluidic partitions functioning as chemical reactors 12 containing the sample. One advantage of this system 1 is that the device itself is not heated by the electromagnetic radiation. The frequency band of the microwaves is large—roughly 0.3 to 300 GHz. In the middle of this spectrum, 18 to 26 GHz has been shown to be ideal for absorption at MEMS length scales, but "millimeter wave" radiation ~100 GHz) will also couple energy well, as the wavelength more closely approaches the MEMS cavity dimensions.

With the system 1 little energy is wasted heating the device and instead is absorbed heating the sample within the micro-channel flow channel 8. Many microfluidic devices partition the flow between the aqueous phase and either oil or air/nitrogen flows, both of these continuous phase fluids have dielectric permittivities much less than water. Therefore the carrier fluid for partitioning the chemical reactors in microfluidic devices is not effectively heated by the EM source, and subsequently can immediately cool the fluid droplets as soon as the radiation is cycled off. Thus a chilled oil stream with interspersed droplets can be a highly efficient thermal cycler, operating at speeds orders of magnitude better than what is capable today.

The microwave power absorbed per unit volume is $P_v=\sigma E^2$, where E is the electric field and $\sigma=2\pi f\varepsilon_0\varepsilon''$, f is the frequency in Hz, $\varepsilon_0$ is the permittivity of free space, and $\varepsilon''$ is the complex part of the permittivity of the material. ($\varepsilon''_{aq}>>\varepsilon''_{oil}$). Looking at the energy required to individually heat 50 μm droplets over the temperature range of use in PCR (assuming ⅓ of a second is sufficiently fast):

$$m=\rho V_{droplet}=\rho\frac{4}{3}\pi r^3\cong 6.53\cdot 10^{-11}\ \text{kg}$$

$$\dot{Q}=mC_p\frac{dT}{dt}=6.53\cdot 10^{-11}\cdot 4{,}186\frac{(95-30)}{0.33}=53.8\ \mu\text{W}$$

The absorbed power required to heat droplets 12 of this size from 30° C. to 95° C. in a third of a second is only 53.8 μW. This implies that a milliwatt-capable microwave source can easily heat an entire channel of droplets if the channel acts as a cavity or waveguide, focusing the energy to resonate in the channel (and the contained droplets). Increasing applied power will only decrease the time required. Droplet heating can be instantaneous, such that continuous flow operation (droplet generation at an upstream T-junction, for example) can be maintained.

Additionally, the system allows for optical addressability of the cavity or waveguide, which allows fluorescence detection of temperature, pH, nucleic acid amplification (for PCR), or direct optical observation of cell lysis, sedimentation, and other signals and observations under test for the real-time microfluidic device.

Figure 2A:
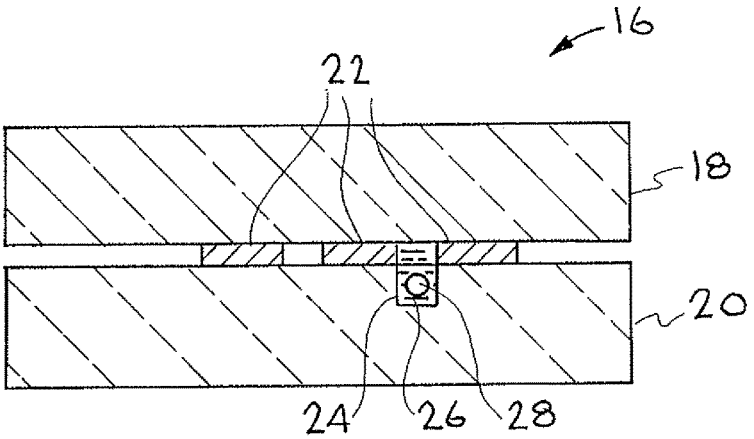
FIG. 2 illustrates another embodiment of the present invention.
Figure 2B:
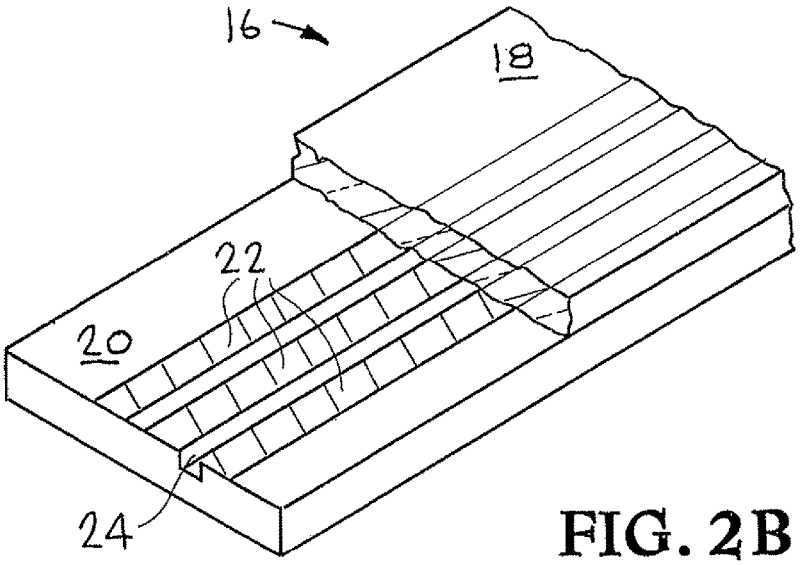
Figure 2C:
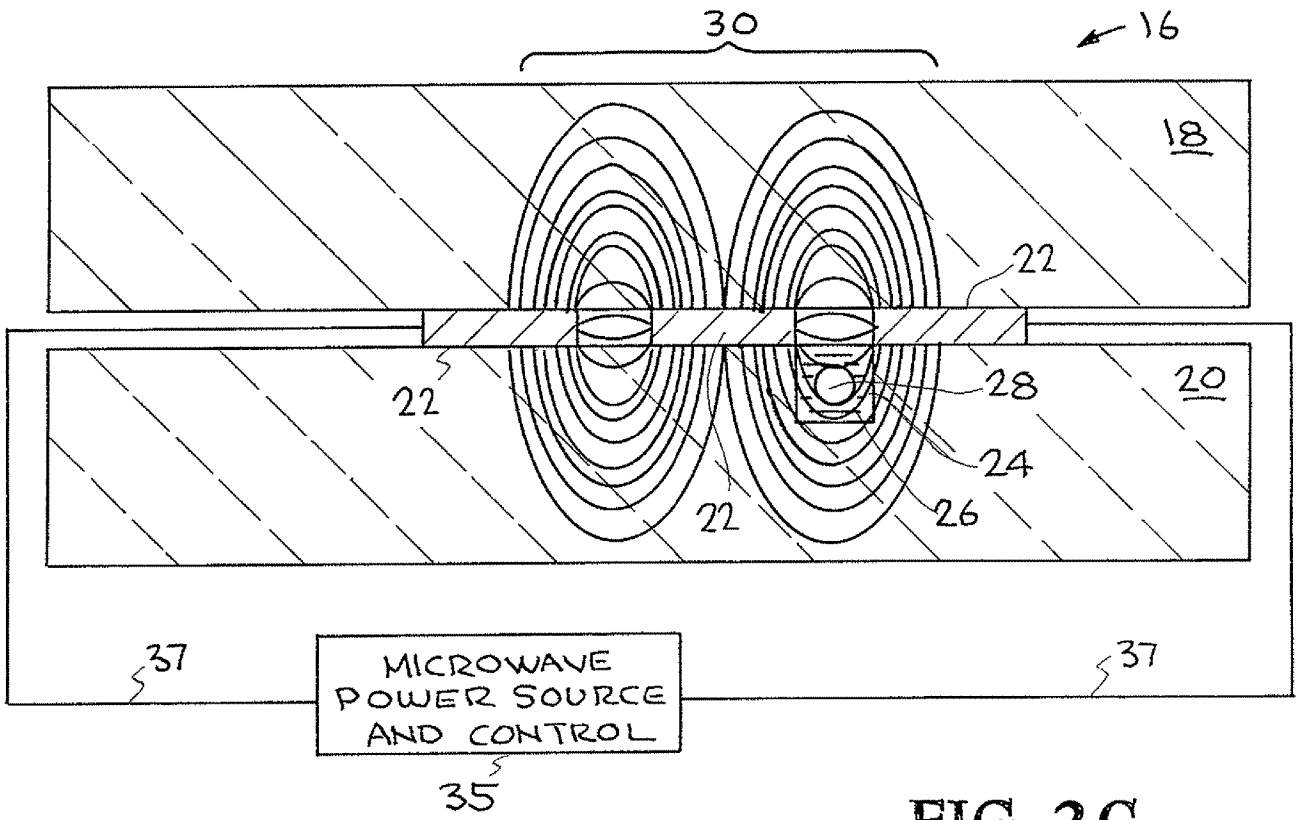

Referring now to FIGS. 2A, 2B, and 2C; another embodiment of a system constructed in accordance with the present invention is illustrated. The system is designated generally by the reference numeral 16. The system 16 is a co-planar waveguide with a shallow channel. The system 16 provides extremely rapid and efficient heating of fluidic (aqueous or organic) solutions within continuous streams or segmented micro-droplets on a micro-electro-mechanical system (MEMS) device.

Referring to FIG. 2A, the system 16 includes a silicon substrate 20. A micro channel 24 is located in the silicon substrate 20. The micro channel 24 is 60 μm wide and 60 μm deep. The micro channel 24 serves as a channel for oil 26 carrying a micro-droplet 28. The micro-droplet 28 contains a sample to be analyzed as will be explained subsequently. Conductive traces 22 are positioned on the silicon substrate 20 proximate the micro channel 24. The conductive traces 22 are 1 μm thick copper conductive traces. A glass cover plate 18 is positioned over the silicon substrate 20, the micro channel 24, and the conductive traces 22.

Referring to FIG. 2B, the micro channel 24 is shown extending along the silicon substrate 20. The conductive traces 22 are positioned on the silicon substrate 20 proximate the micro channel 24. The glass cover plate 18 is positioned over the silicon substrate 20, the micro channel 24, and the conductive traces 22.

Referring to FIG. 2C, the three conductive traces 22 are shown connected to a microwave power source and control 35 by connectors 37. In operation the microwave power source and control 35 energizes the three conductive traces 22 producing field lines 30. The microwave power source and control 35 provides microwaves that heat the sample in the micro-droplet 28 located in the micro channel 24.

The structural details of the system 16 having been described the operation of the system 16 will now be considered. A carrier fluid source introduces the oil carrier fluid 26 into the micro-channel flow channel 24. The sample to be heated and/or analyzed is introduced to the micro-channel flow channel 24 by a droplet maker or other device that produces droplets or micro-reactors 28. The sample is contained within the droplets or micro-reactors 28 and can be bacterial cells, virus particles, nucleic acids, proteins, biomolecules, chemical agents, explosives agents, and other targets of interest.

The droplets or micro-reactors 28 containing the sample are carried to the heating area by the oil carrier fluid 26. The microwave source 35 transmits microwaves 30 into the micro-channel flow channel 24 in the heating area. The microwave source includes the copper traces 22 that serve as electrodes and produce the microwaves 30. The microwaves 30 from the microwave source are directed to focus the microwaves 30 into the microfluidic channel 24 in the heating area. The silicon substrate 24, the glass cover 18, as well as the oil carrier fluid 26 are not appreciably heated. The system 16 utilizes microwave energy absorption to instantaneously heat fluidic partitions functioning as chemical reactors 28 containing the sample. One advantage of this system 16 is that the device itself is not heated by the electromagnetic radiation. The frequency band of the microwaves is large—roughly 0.3 to 300 GHz. In the middle of this spectrum, 18 to 26 GHz has been shown to be ideal for absorption at MEMS length scales, but "millimeter wave" radiation ~100 GHz) will also couple energy well, as the wavelength more closely approaches the MEMS cavity dimensions.

With the system 16 little energy is wasted heating the device and instead is absorbed heating the sample within the micro-channel flow channel 24. Many microfluidic devices partition the flow between the aqueous phase and either oil or air/nitrogen flows, both of these continuous phase fluids have dielectric permittivities much less than water. Therefore the carrier fluid for partitioning the chemical reactors in microfluidic devices is not effectively heated by the EM source, and subsequently can immediately cool the fluid droplets as soon as the radiation is cycled off. Thus a chilled oil stream with interspersed droplets can be a highly efficient thermal cycler, operating at speeds orders of magnitude better than what is capable today.

Figure 3A:
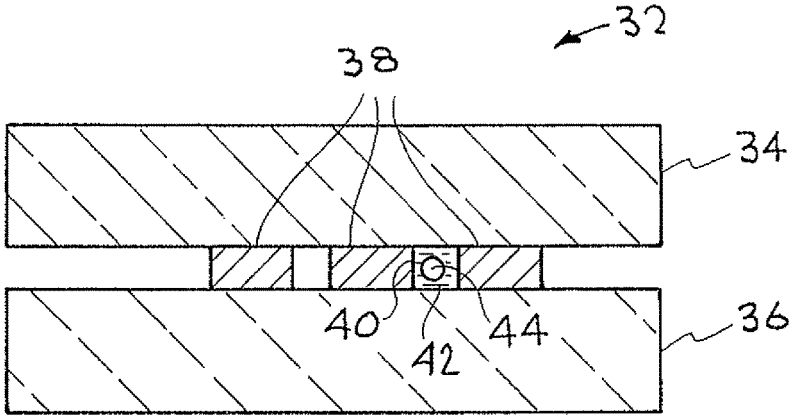
FIG. 3 illustrates yet another embodiment of the present invention.
Figure 3B:
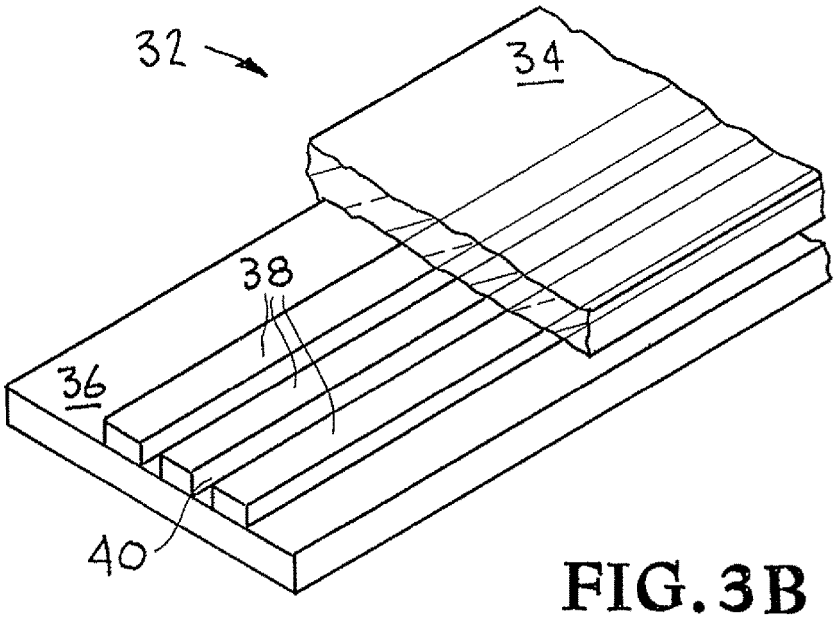
Figure 3C:
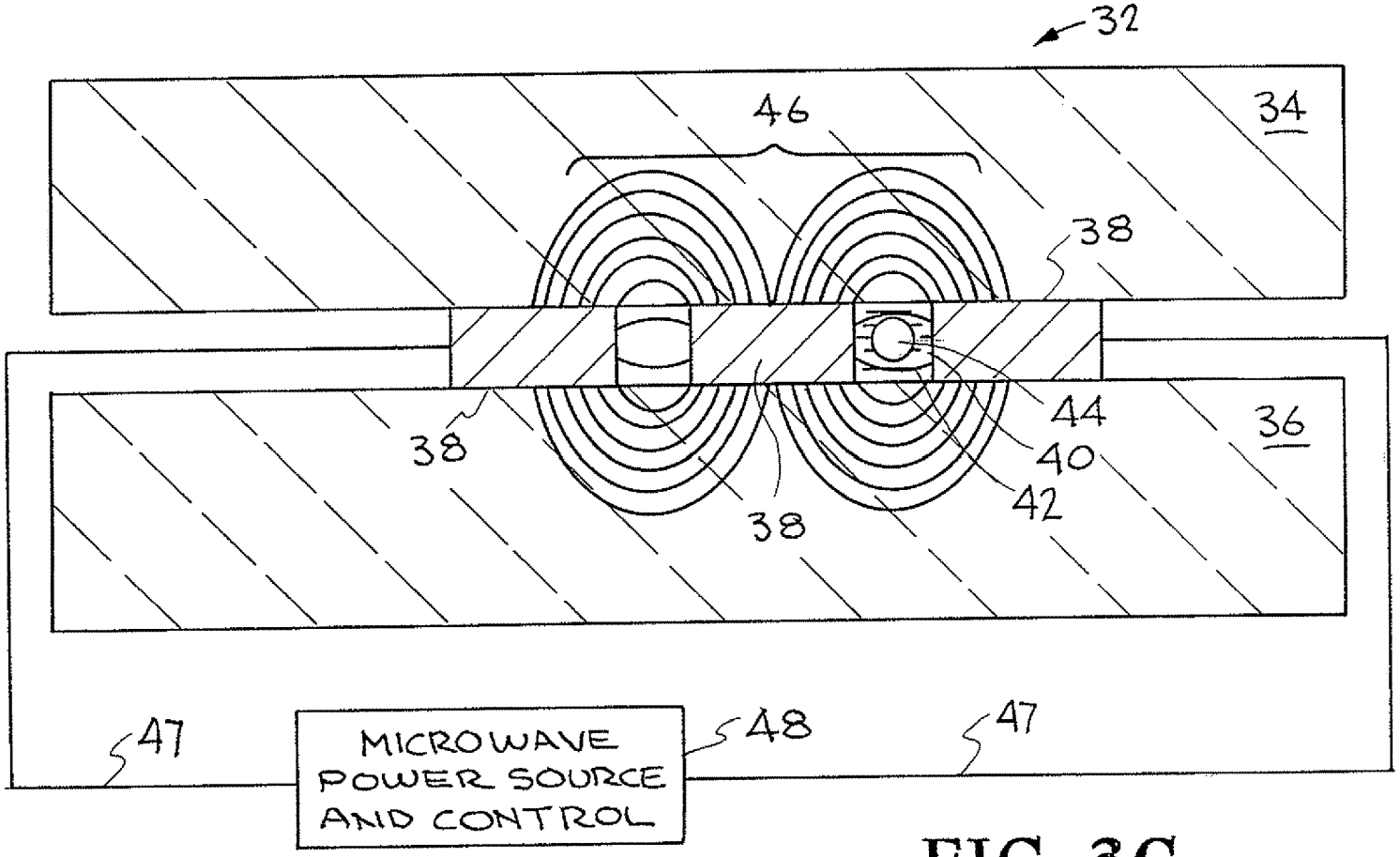

Referring now to FIGS. 3A, 3B, and 3C; another embodiment of a system constructed in accordance with the present invention is illustrated. The system is designated generally by the reference numeral 32. The system 32 is a co-planar waveguide. The system 32 provides extremely rapid and efficient heating of fluidic (aqueous or organic) solutions within continuous streams or segmented micro-droplets on a micro-electro-mechanical system (MEMS) device.

Referring to FIG. 3A, the system 32 includes a silicon substrate 36. A micro channel 40 is located on the silicon substrate 36 between adjacent conductive strips 38. The micro channel 40 is 60 μm wide and 70 μm deep. The micro channel 40 serves as a channel for oil 42 carrying a micro-droplet 44. The micro-droplet 44 contains a sample to be analyzed as will be explained subsequently. The conductive strips 38 are positioned on the silicon substrate 36 and serve as walls for the micro channel 40. The conductive strips 38 are 2 oz. copper strips that are 70 μm thick. A glass cover plate 34 is positioned over the silicon substrate 36, the micro channel 40, and the conductive strips 38.

Referring to FIG. 3B, the micro channel 40 is shown extending on the surface of the silicon substrate 36. The conductive strips 38 are positioned on the silicon substrate 36 and form the micro channel 40. The glass cover plate 34 is positioned over the silicon substrate 36, the micro channel 40, and the conductive strips 38.

Referring to FIG. 3C, the three conductive strips 38 are shown connected to a microwave power source and control 48 by connectors 47. In operation the microwave power source and control 48 energizes the three conductive strips 38 producing field lines 46. The microwave power source and control 48 provides microwaves that heat the sample in the micro-droplet 44 located in the micro channel 40.

The structural details of the system 32 having been described the operation of the system 32 will now be considered. A carrier fluid source introduces the oil carrier fluid 42 into the micro-channel flow channel 40. The sample to be heated and/or analyzed is introduced to the micro-channel flow channel 40 by a droplet maker or other device that produces droplets or micro-reactors 44. The sample is contained within the droplets or micro-reactors 44 and can be bacterial cells, virus particles, nucleic acids, proteins, biomolecules, chemical agents, explosives agents, and other targets of interest.

The droplets or micro-reactors 44 containing the sample are carried to the heating area by the oil carrier fluid 42. The microwave source 48 transmits microwaves 46 into the micro-channel flow channel 40 in the heating area. The microwave source includes the copper strips 38 that serve as electrodes and produce the microwaves 46. The microwaves 46 from the microwave source are directed to focus the microwaves 46 into the microfluidic channel 40 in the heating area. The silicon substrate 36, the glass cover 34, as well as the oil carrier fluid 42 are not appreciably heated. The system 32 utilizes microwave energy absorption to instantaneously heat fluidic partitions functioning as chemical reactors 44 containing the sample. One advantage of this system 32 is that the device itself is not heated by the electromagnetic radiation. The frequency band of the microwaves is large—roughly 0.3 to 300 GHz. In the middle of this spectrum, 18 to 26 GHz has been shown to be ideal for absorption at MEMS length scales, but "millimeter wave" radiation ~100 GHz) will also couple energy well, as the wavelength more closely approaches the MEMS cavity dimensions.

With the system 32 little energy is wasted heating the device and instead is absorbed heating the sample within the micro-channel flow channel 40. Many microfluidic devices partition the flow between the aqueous phase and either oil or air/nitrogen flows, both of these continuous phase fluids have dielectric permittivities much less than water. Therefore the carrier fluid for partitioning the chemical reactors in microfluidic devices is not effectively heated by the EM source, and subsequently can immediately cool the fluid droplets as soon as the radiation is cycled off. Thus a chilled oil stream with interspersed droplets can be a highly efficient thermal cycler, operating at speeds orders of magnitude better than what is capable today.

Figure 4A:
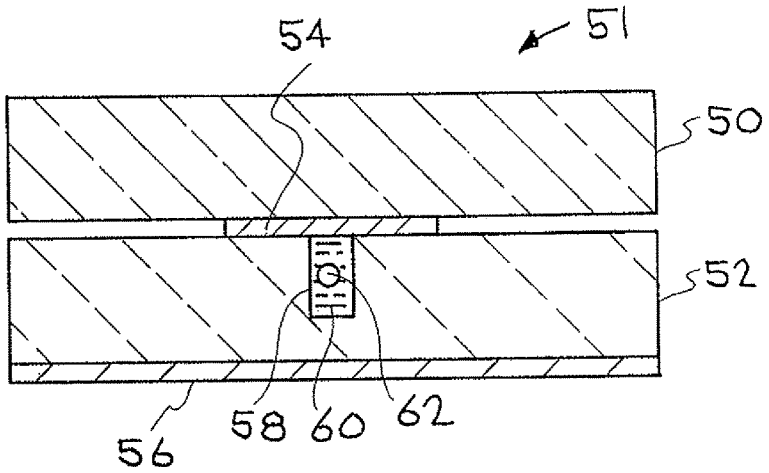
FIG. 4 illustrates another embodiment of the present invention.
Figure 4B:
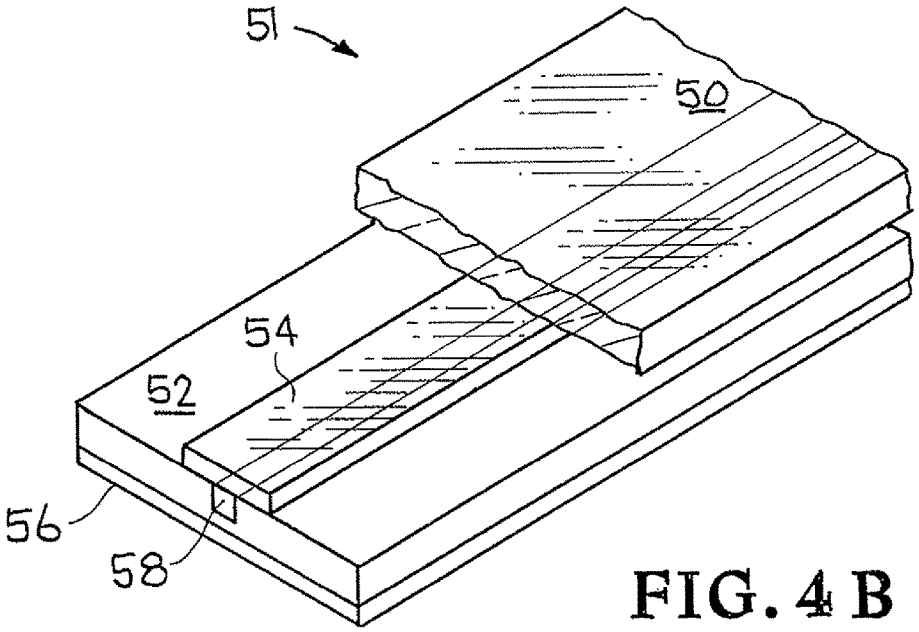
Figure 4C:
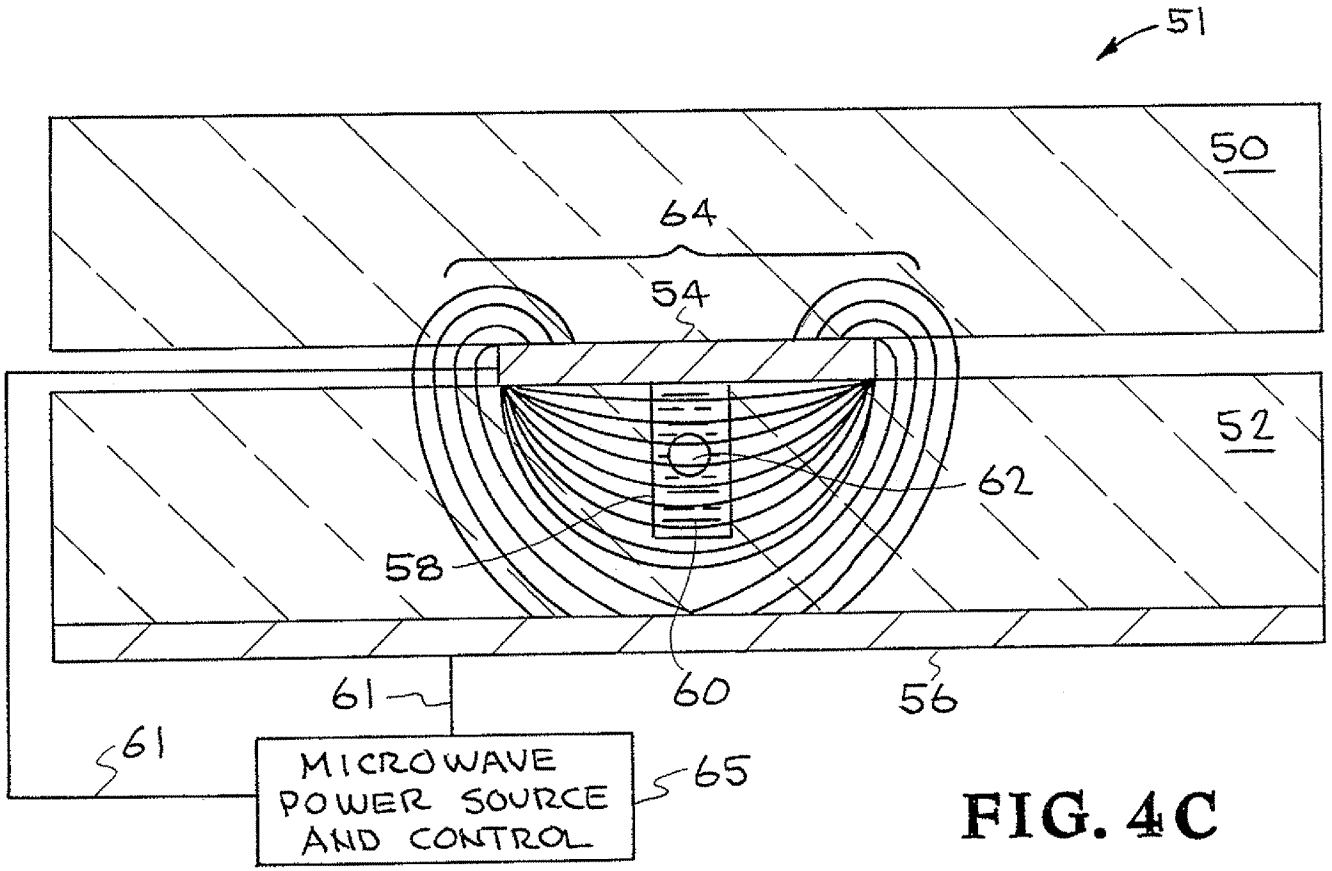

Referring now to FIGS. 4A, 4B, and 4C; another embodiment of a system constructed in accordance with the present invention is illustrated. The system is designated generally by the reference numeral 51. The system 51 is an Indium Tin Oxide (ITO) micro strip with a deep channel. The system 51 provides extremely rapid and efficient heating of fluidic (aqueous or organic) solutions within continuous streams or segmented micro-droplets on a micro-electro-mechanical system (MEMS) device.

Referring to FIG. 4A, the system 51 includes a silicon substrate 52. A micro channel 58 is located in the silicon substrate 52. The micro channel 58 is 60 μm wide and 300 μm deep. The micro channel 58 serves as a channel for oil 60 carrying a micro-droplet 62. The micro-droplet 62 contains a sample to be analyzed as will be explained subsequently. ITO microstrip 54 and ITO microstrip 56 are positioned on the silicon substrate 52 proximate the micro channel 58. The ITO microstrip 54 and ITO microstrip 56 are made of Indium Tin Oxide (ITO). A glass cover plate 50 is positioned over the silicon substrate 52, the micro channel 58, the ITO microstrip 54, and ITO microstrip 56.

Referring to FIG. 4B, the micro channel 58 is shown extending along the silicon substrate 52. The ITO microstrip 54 and ITO microstrip 56 are positioned on the silicon substrate 52 proximate the micro channel 58. The glass cover plate 50 is positioned over the ITO microstrip 54, the silicon substrate 52, the ITO microstrip 56, and the micro channel 58.

Referring to FIG. 4C, the ITO microstrip 54 and ITO microstrip 56 are shown connected to a microwave power source and control 65 by connectors 61. In operation the microwave power source and control 65 energizes the ITO microstrip 54 and ITO microstrip 56 producing field lines 64. The microwave power source and control 65 provides microwaves 64 that heat the sample in the micro-droplet 62 located in the micro channel 58. The ITO microstrip 54 is positioned over the micro channel 58. Since Indium Tin Oxide (ITO) is transparent to visible light the sample in the micro-droplet 62 can be observed.

The structural details of the system 51 having been described the operation of the system 51 will now be considered. A carrier fluid source introduces the oil carrier fluid 60 into the micro-channel flow channel 58. The sample to be heated and/or analyzed is introduced to the micro-channel flow channel 58 by a droplet maker or other device that produces droplets or micro-reactors 62. The sample is contained within the droplets or micro-reactors 62 and can be bacterial cells, virus particles, nucleic acids, proteins, biomolecules, chemical agents, explosives agents, and other targets of interest.

The droplets or micro-reactors 62 containing the sample are carried to the heating area by the oil carrier fluid 60. The microwave source 65 transmits microwaves 64 into the micro-channel flow channel 58 in the heating area. The microwave source includes the ITO microstrip 54 and ITO microstrip 56 that serve as electrodes and produce the microwaves 64. The microwaves 64 from the microwave source are directed to focus the microwaves 64 into the microfluidic channel 58 in the heating area. The silicon substrate 52, the glass cover 50, as well as the oil carrier fluid 60 are not appreciably heated. The system 48 utilizes microwave energy absorption to instantaneously heat fluidic partitions functioning as chemical reactors 62 containing the sample. One advantage of this system 51 is that the device itself is not heated by the electromagnetic radiation. The frequency band of the microwaves is large—roughly 0.3 to 300 GHz. In the middle of this spectrum, 18 to 26 GHz has been shown to be ideal for absorption at MEMS length scales, but "millimeter wave" radiation ~100 GHz) will also couple energy well, as the wavelength more closely approaches the MEMS cavity dimensions.

With the system 51 little energy is wasted heating the device and instead is absorbed heating the sample within the micro-channel flow channel 58. Many microfluidic devices partition the flow between the aqueous phase and either oil or air/nitrogen flows, both of these continuous phase fluids have dielectric permittivities much less than water. Therefore the carrier fluid for partitioning the chemical reactors in microfluidic devices is not effectively heated by the EM source, and subsequently can immediately cool the fluid droplets as soon as the radiation is cycled off. Thus a chilled oil stream with interspersed droplets can be a highly efficient thermal cycler, operating at speeds orders of magnitude better than what is capable today.

Figure 5A:
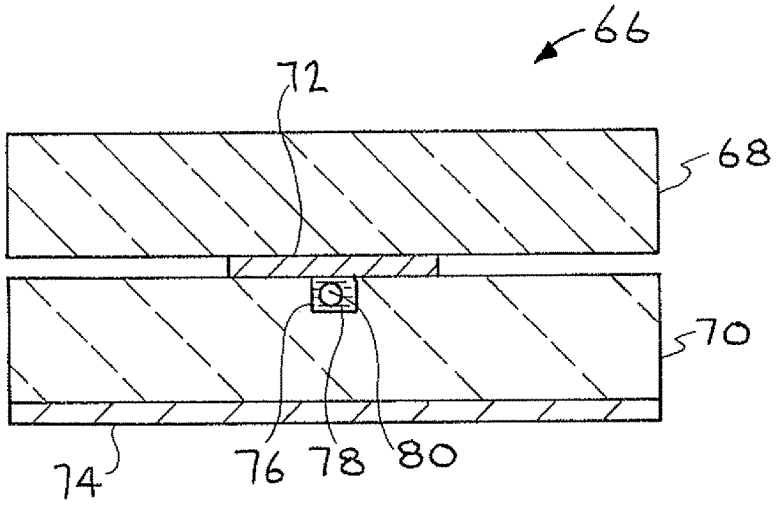
FIG. 5 illustrates another embodiment of the present invention.
Figure 5B:
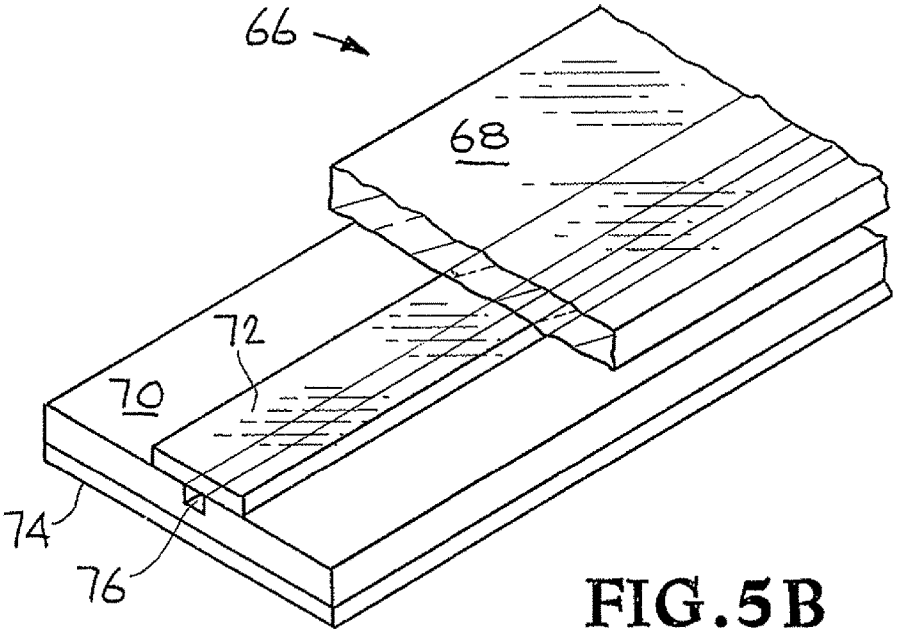
Figure 5C:
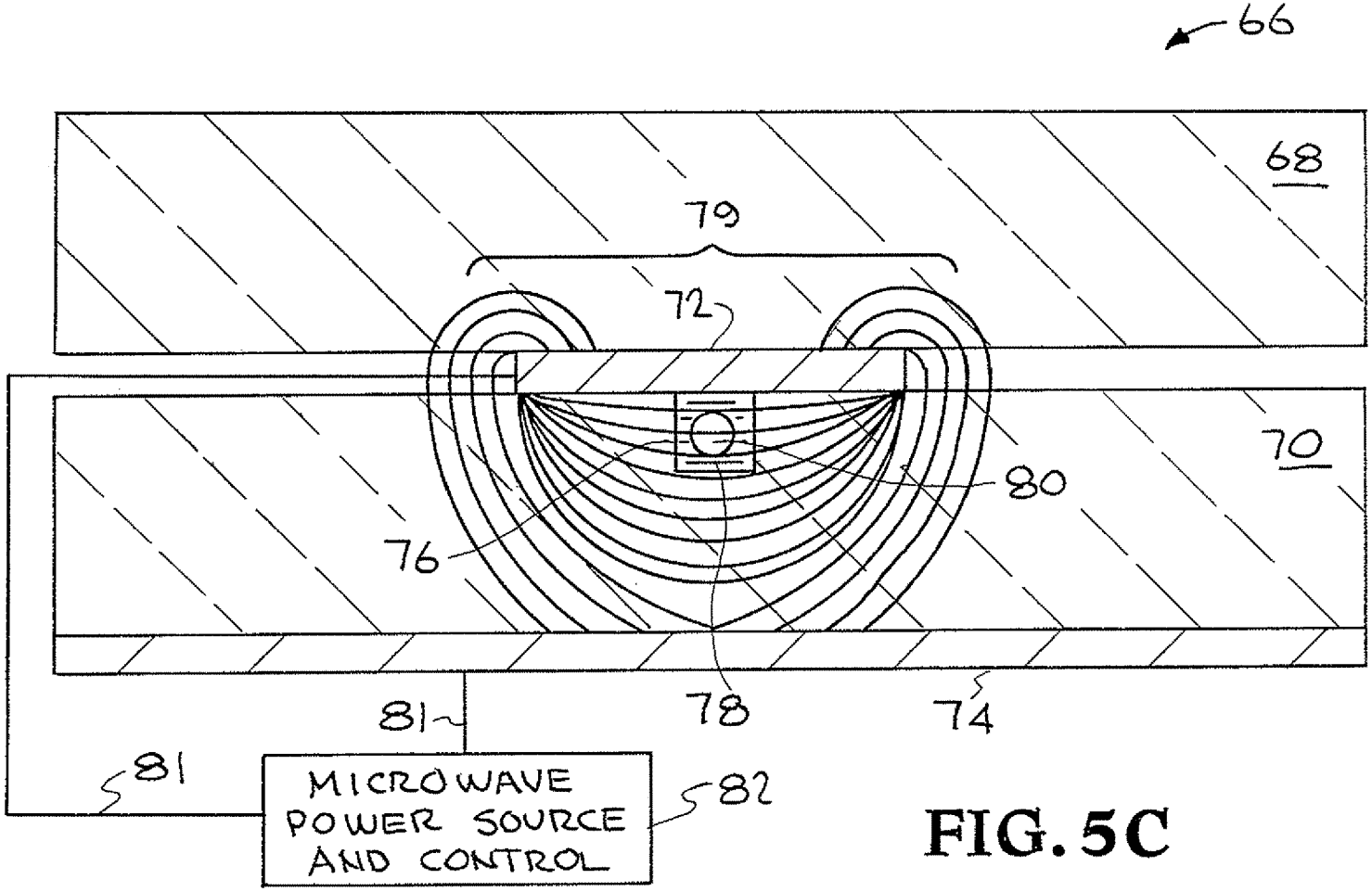

Referring now to FIGS. 5A, 5B, and 5C; another embodiment of a system constructed in accordance with the present invention is illustrated. The system is designated generally by the reference numeral 66. The system 66 is an Indium Tin Oxide (ITO) micro strip with a shallow channel. The system 66 provides extremely rapid and efficient heating of fluidic (aqueous or organic) solutions within continuous streams or segmented micro-droplets on a micro-electro-mechanical system (MEMS) device.

Referring to FIG. 5A, the system 66 includes a silicon substrate 70. A micro channel 76 is located in the silicon substrate 70. The micro channel 76 is 60 μm wide and 60 μm deep. The micro channel 76 serves as a channel for oil 78 carrying a micro-droplet 80. The micro-droplet 80 contains a sample to be analyzed as will be explained subsequently. ITO microstrip 72 and ITO microstrip 74 are positioned on the silicon substrate 70 proximate the micro channel 76. The ITO microstrip 72 and ITO microstrip 74 are made of Indium Tin Oxide (ITO). A glass cover plate 68 is positioned over the silicon substrate 70, the micro channel 76, the ITO microstrip 72, and ITO microstrip 74.

Referring to FIG. 5B, the micro channel 76 is shown extending along the silicon substrate 70. The ITO microstrip 72 and ITO microstrip 74 are positioned on the silicon substrate 70 proximate the micro channel 76. The glass cover plate 68 is positioned over the silicon substrate 70, the micro channel 76, the ITO microstrip 72, and ITO microstrip 74.

Referring to FIG. 5C, the ITO microstrip 72 and ITO microstrip 74 are shown connected to a microwave power source and control 82 by connectors 81. In operation the microwave power source and control 82 energizes the ITO microstrip 72 and ITO microstrip 74 producing field lines 79. The microwave power source and control 82 provides microwaves 79 that heat the sample in the micro-droplet 80 located in the micro channel 76. The ITO microstrip 72 is positioned over the micro channel 76. Since Indium Tin Oxide (ITO) is transparent to visible light the sample in the micro-droplet 80 can be observed.

The structural details of the system 66 having been described the operation of the system 66 will now be considered. A carrier fluid source introduces the oil carrier fluid 78 into the micro-channel flow channel 76. The sample to be heated and/or analyzed is introduced to the micro-channel flow channel 76 by a droplet maker or other device that produces droplets or micro-reactors 80. The sample is contained within the droplets or micro-reactors 80 and can be bacterial cells, virus particles, nucleic acids, proteins, biomolecules, chemical agents, explosives agents, and other targets of interest.

The droplets or micro-reactors 80 containing the sample are carried to the heating area by the carrier fluid 78. The microwave source 82 transmits microwaves 79 into the micro-channel flow channel 76 in the heating area. The microwave source includes the ITO microstrip 72 and ITO microstrip 74 that serve as electrodes and produce the microwaves 79. The microwaves 79 from the microwave source are directed to focus the microwaves 79 into the microfluidic channel 76 in the heating area. The silicon substrate 76, the glass cover 68, as well as the oil carrier fluid 78 are not appreciably heated. The system 66 utilizes microwave energy absorption to instantaneously heat fluidic partitions functioning as chemical reactors 80 containing the sample. One advantage of this system 66 is that the device itself is not heated by the electromagnetic radiation. The frequency band of the microwaves is large—roughly 0.3 to 300 GHz. In the middle of this spectrum, 18 to 26 GHz has been shown to be ideal for absorption at MEMS length scales, but "millimeter wave" radiation ~100 GHz) will also couple energy well, as the wavelength more closely approaches the MEMS cavity dimensions.

With the system 66 little energy is wasted heating the device and instead is absorbed heating the sample within the micro-channel flow channel 76. Many microfluidic devices partition the flow between the aqueous phase and either oil or air/nitrogen flows, both of these continuous phase fluids have dielectric permittivities much less than water. Therefore the carrier fluid for partitioning the chemical reactors in microfluidic devices is not effectively heated by the EM source, and subsequently can immediately cool the fluid droplets as soon as the radiation is cycled off. Thus a chilled oil stream with interspersed droplets can be a highly efficient thermal cycler, operating at speeds orders of magnitude better than what is capable today.

Figure 6:
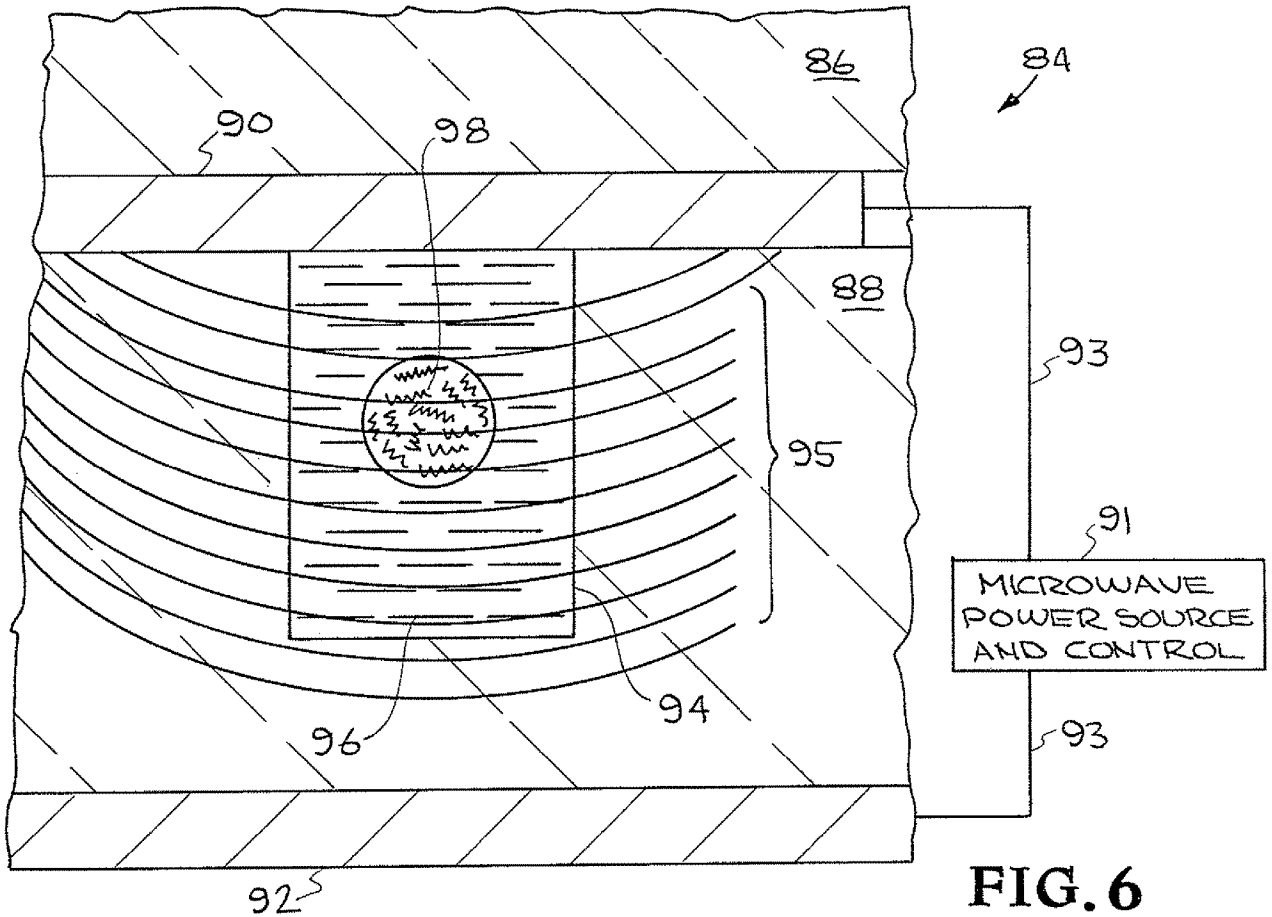
FIG. 6 illustrates yet another embodiment of the present invention.

Referring now to FIG. 6; another embodiment of a system constructed in accordance with the present invention is illustrated. The system is designated generally by the reference numeral 84. The system 84 provides extremely rapid and efficient heating of fluidic (aqueous or organic) solutions within continuous streams or segmented micro-droplets on a micro-electro-mechanical system (MEMS) device.

Referring to FIG. 6, the system 84 includes a silicon substrate 88. A micro channel 94 is located in the silicon substrate 88. The micro channel 94 serves as a channel for oil 96 carrying a micro-droplet 98. The micro-droplet 98 contains a sample to be analyzed as will be explained subsequently. ITO microstrip 90 and ITO microstrip 92 are positioned on the silicon substrate 88 proximate to the micro channel 94. The ITO microstrip 90 and ITO microstrip 92 are made of Indium Tin Oxide (ITO). A glass cover plate 86 is positioned over the silicon substrate 88, the micro channel 94, the ITO microstrip 90, and ITO microstrip 92.

Referring again to FIG. 6, the ITO microstrip 90 and ITO microstrip 92 are shown connected to a microwave power source and control 91 by connectors 93. In operation the microwave power source and control 91 energizes the ITO microstrip 90 and ITO microstrip 92 producing field lines 95. The microwave power source and control 91 provides microwaves 95 that heat the sample in the micro-droplet 98 located in the micro channel 94. The ITO microstrip 90 is positioned over the micro channel 94. Since Indium Tin Oxide (ITO) is transparent to visible light the sample in the micro-droplet 98 can be observed.

The structural details of the system 84 having been described the operation of the system 84 will now be considered. A carrier fluid source introduces the oil carrier fluid 96 into the micro-channel flow channel 94. The sample to be heated and/or analyzed is introduced to the micro-channel flow channel 94 by a droplet maker or other device that produces droplets or micro-reactors 98. The sample is contained within the droplets or micro-reactors 98 and can be bacterial cells, virus particles, nucleic acids, proteins, biomolecules, chemical agents, explosives agents, and other targets of interest.

The droplets or micro-reactors 98 containing the sample are carried to the heating area by the carrier fluid 96. The microwave source 91 transmits microwaves 95 into the micro-channel flow channel 94 in the heating area. The microwave source includes the ITO microstrip 90 and ITO microstrip 92 that serve as electrodes and produce the microwaves 95. The microwaves 95 from the microwave source are directed to focus the microwaves 95 into the microfluidic channel 94 in the heating area. The system 84 produces homogenous field lines 95. The Indium Tin Oxide (ITO) microstrip exhibits the most homogenized field. This is an advantage because the droplets are heated uniformly. Since ITO is transparent, optical access is maintained for amplification detection. Another advantage is the relatively large width of the microstrip makes wafer registration (assembly) less demanding, as the method is highly insensitive to misalignment.

The silicon substrate 88, the glass cover 86, as well as the oil carrier fluid 96 are not appreciably heated. The system 84 utilizes microwave energy absorption to instantaneously heat fluidic partitions functioning as chemical reactors 98 containing the sample. One advantage of this system 84 is that the device itself is not heated by the electromagnetic radiation. The frequency band of the microwaves is large—roughly 0.3 to 300 GHz. In the middle of this spectrum, 18 to 26 GHz has been shown to be ideal for absorption at MEMS length scales, but "millimeter wave" radiation ~100 GHz) will also couple energy well, as the wavelength more closely approaches the MEMS cavity dimensions.

With the system 84 little energy is wasted heating the device and instead is absorbed heating the sample within the micro-channel flow channel 94. Many microfluidic devices partition the flow between the aqueous phase and either oil or air/nitrogen flows, both of these continuous phase fluids have dielectric permittivities much less than water. Therefore the carrier fluid for partitioning the chemical reactors in microfluidic devices is not effectively heated by the EM source, and subsequently can immediately cool the fluid droplets as soon as the radiation is cycled off. Thus a chilled oil stream with interspersed droplets can be a highly efficient thermal cycler, operating at speeds orders of magnitude better than what is capable today.

Figure 7:
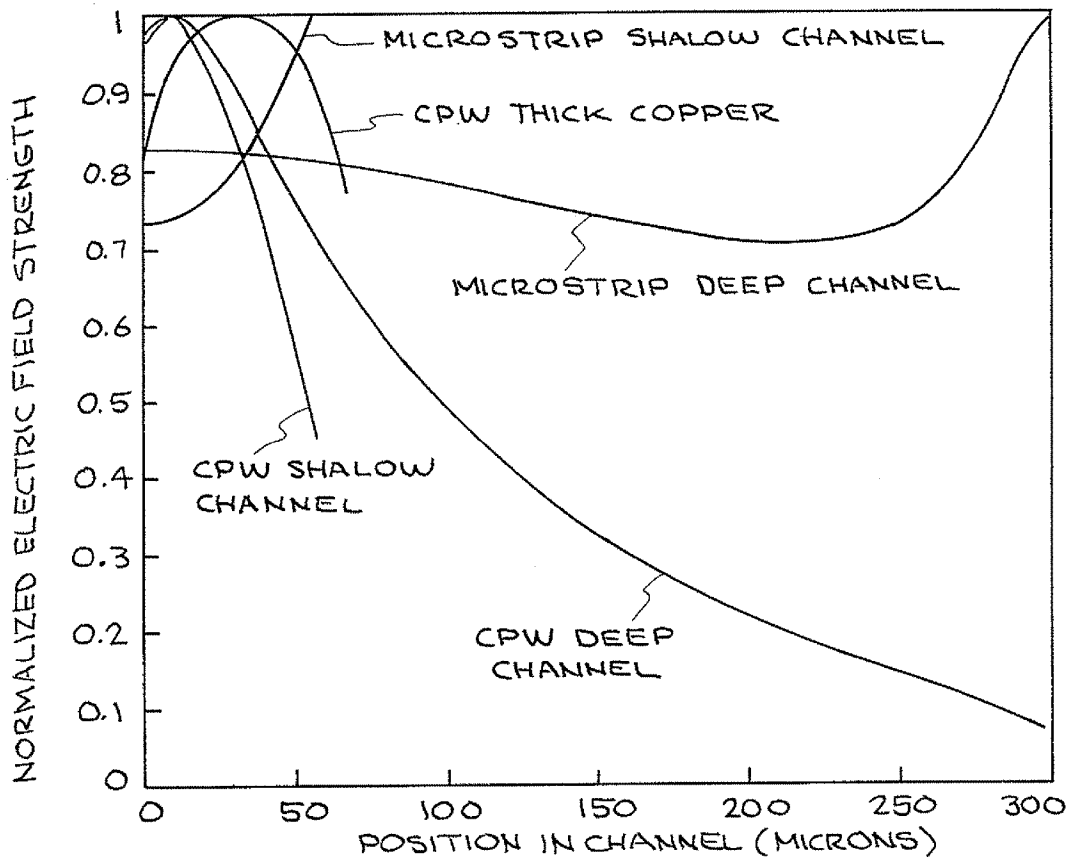
FIG. 7 is a graph that shows normalized electric field strength as a function of channel position.
Figure 8:
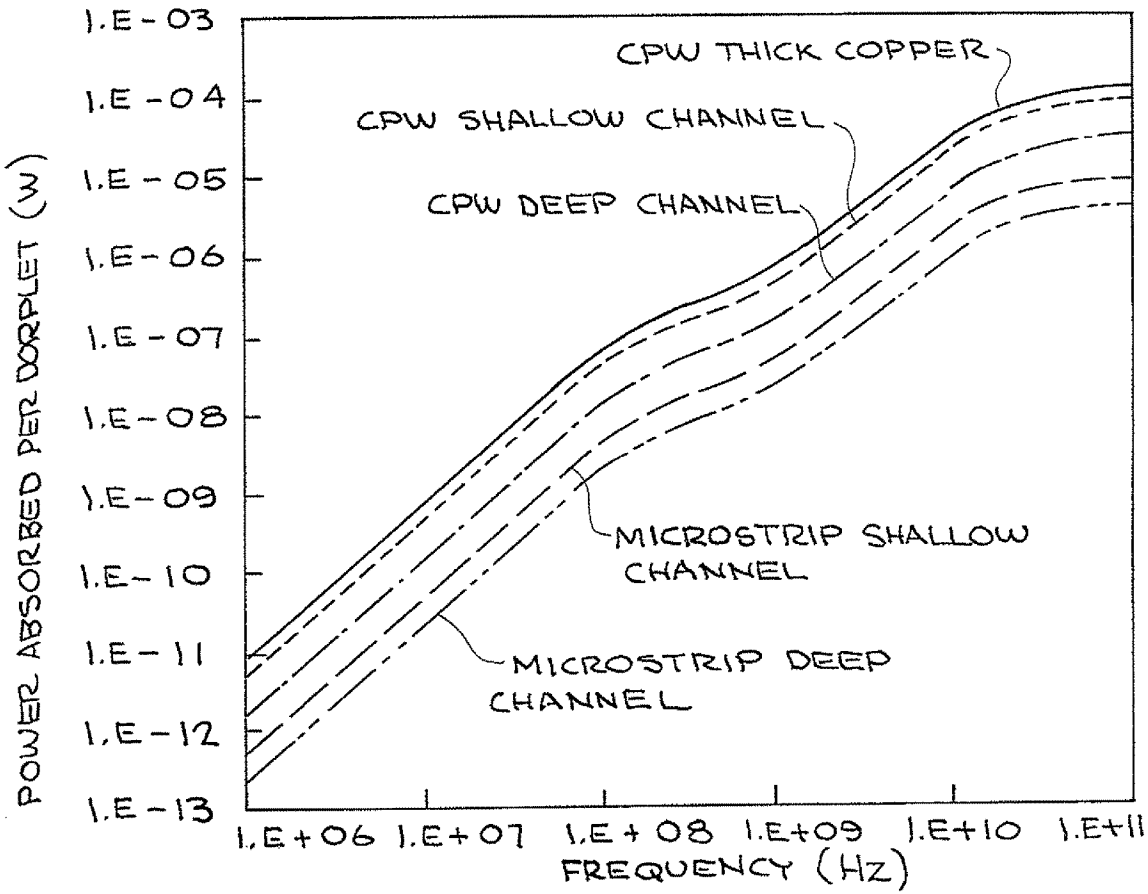
FIG. 8 is a graph that shows droplet absorbed power as a function of wavelength for all configurations.
Figure 9:
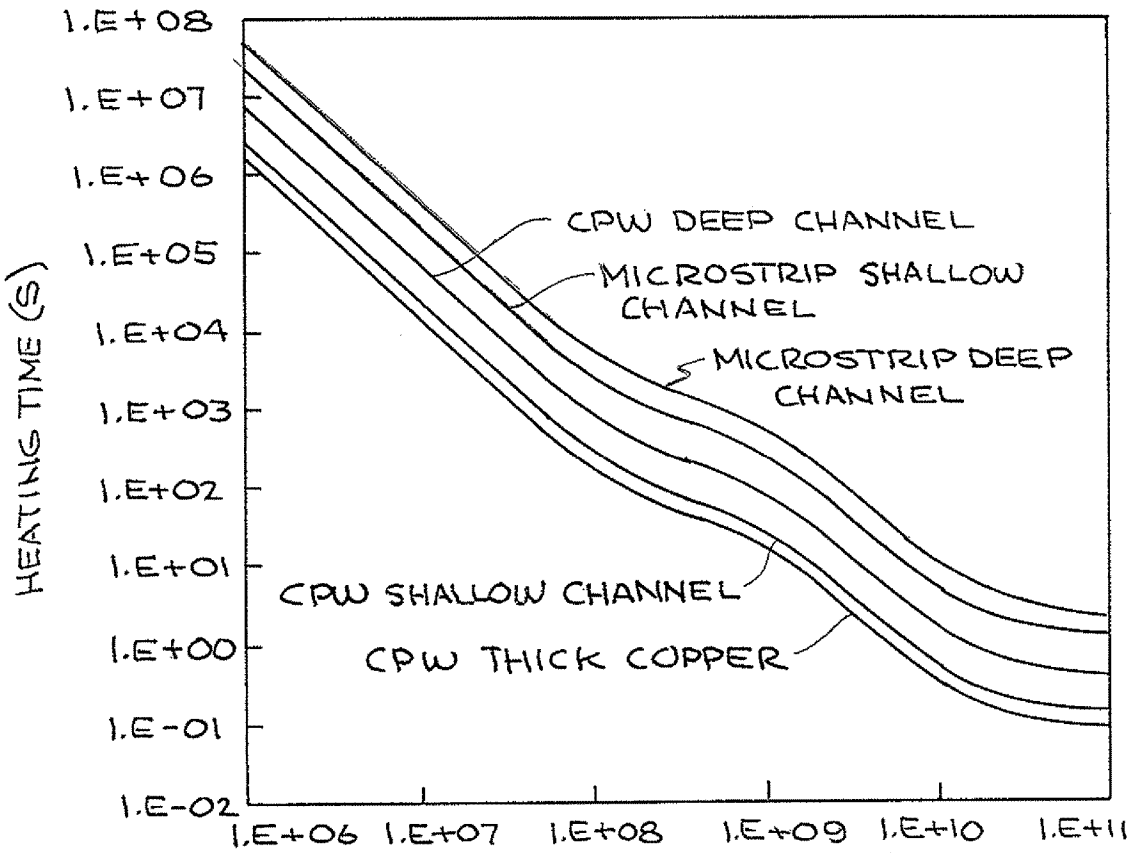
FIG. 9 is a graph that shows time required to heat each droplet from the annealing temperature to the denature temperature for PCR.

FIG. 7 is a graph that shows normalized electric field strength as a function of channel position. FIG. 8 is a graph that shows droplet absorbed power as a function of wavelength for all configurations. FIG. 9 is a graph that shows time required to heat each droplet from the annealing temperature to the denature temperature. The deep channel micro-strip shows the highest insensitivity to droplet position in the channel. This is an strong advantage when it is desired to avoid a thermal gradient developing within the droplets and affecting the PCR amplification efficiency. The relatively low power absorption in the droplets is the strongest reason for selecting one of the CPW configurations. For antenna operation at 2.45 Gigahertz (2-12.24 cm), where microwave sources are plentiful and inexpensive, the power absorbed per droplet varies from 10 nW to approximately 1 W. (This assumes the microwave source is supplying 100 mW of power, and generates a peak electric field of ~180 kVlm in the conductor—a value well below the breakdown voltage in air.)

Figure 10:
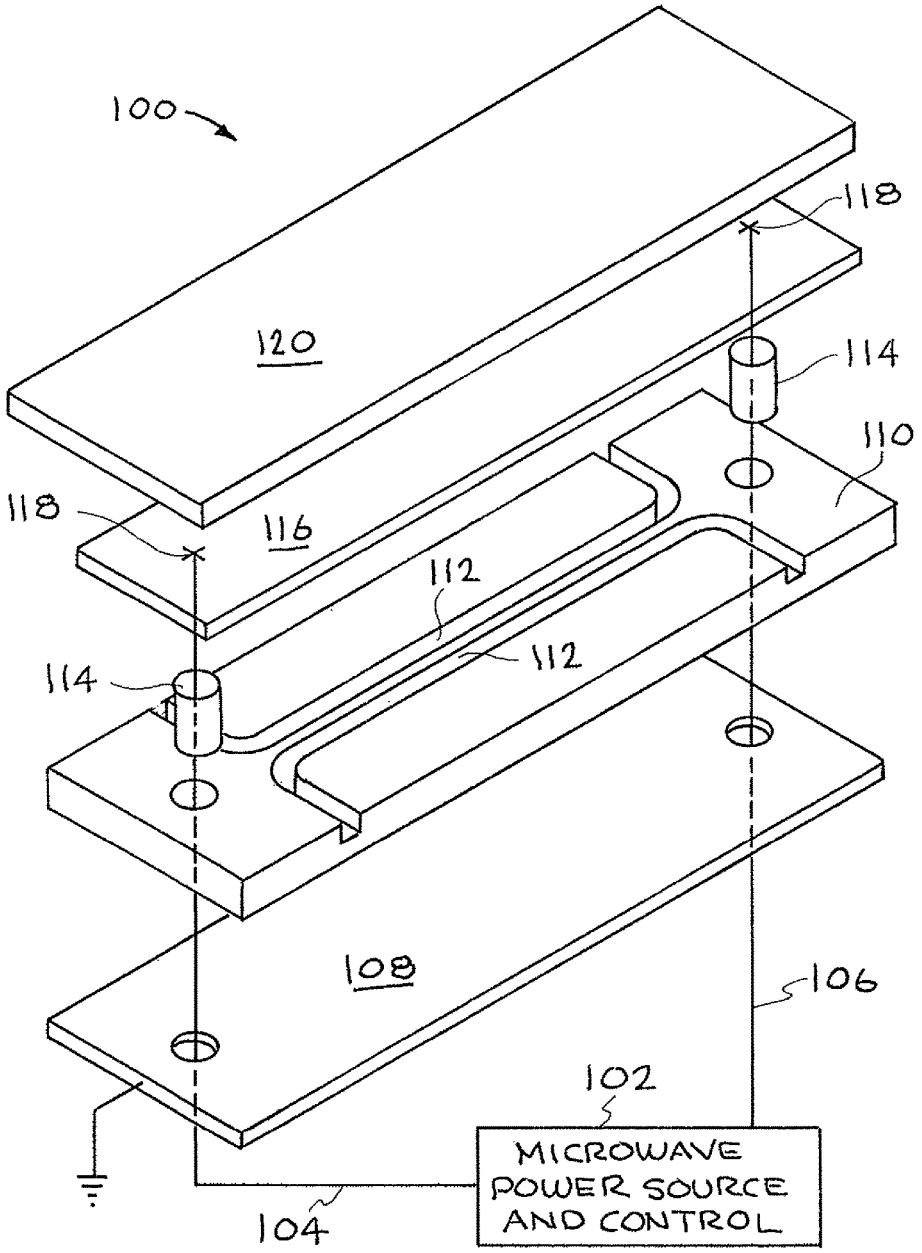
FIG. 10 illustrates another embodiment of the present invention.

Referring now FIGS. 10 thru 15, two embodiments of systems constructed in accordance with the present invention are illustrated. The systems are designated generally by the reference numerals 100 and 200. The system 100 is illustrated in FIG. 10 which is an exploded view of a two conductor circuit system for generating the microwaves used in heating the micro channels. The system 100 illustrated in FIG. 10 includes the following items: power source and control 102, first conductor 104, second conductor 106, lower microstrip 108, substrate 110, microchannels 112, electrical insulators 114, upper microstrip 116, contact points 118, and glass cover plate 120.

The micro wave power source and control 102, the first conductor 104, and second conductor 106 pass thru the lower microstrip 108 and are electrically insulated from the strip 108 by the insulators 114. The conductors 104 and 106 make electrical contact with upper micro strip 116 at contact points 118. The system 100 can be used on all the previously described and illustrated coplanar wave guide and microstrip wave guide systems.

Figure 11:
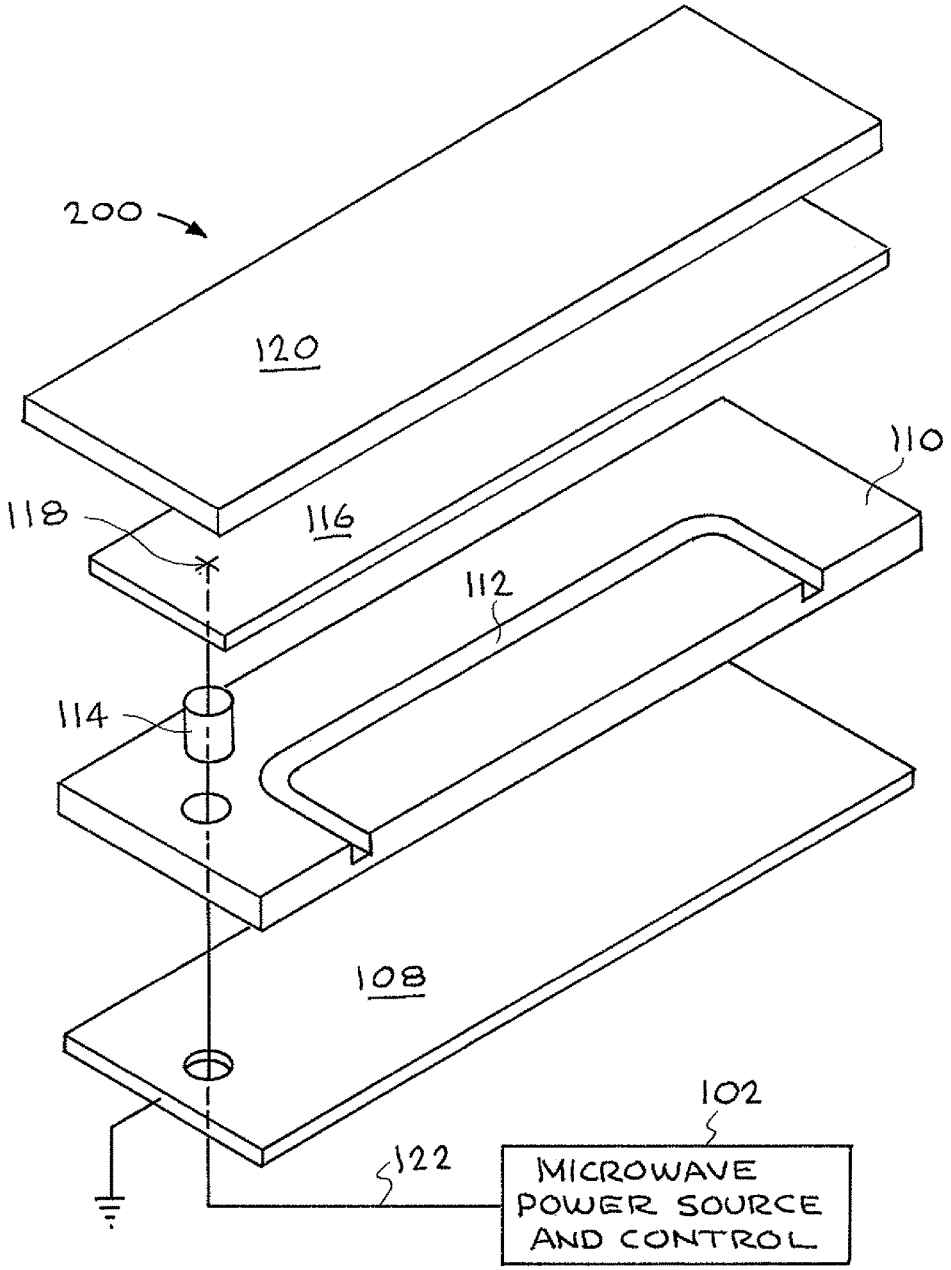
FIG. 11 illustrates yet another embodiment of the present invention.

Referring now FIG. 11 the system 200 is illustrated. FIG. 11 is an exploded view of a single conductor circuit for generating the microwaves used in heating the micro channels. The single conductor circuit illustrated in FIG. 11 consists of the same items of FIG. 10 with the exception of numbering the single conductor as 122. The same description as FIG. 10 also applies to the circuit of FIG. 11. This circuit can also be used for powering the coplanar wave guides and the micro strip wave guide systems.

Figure 12:
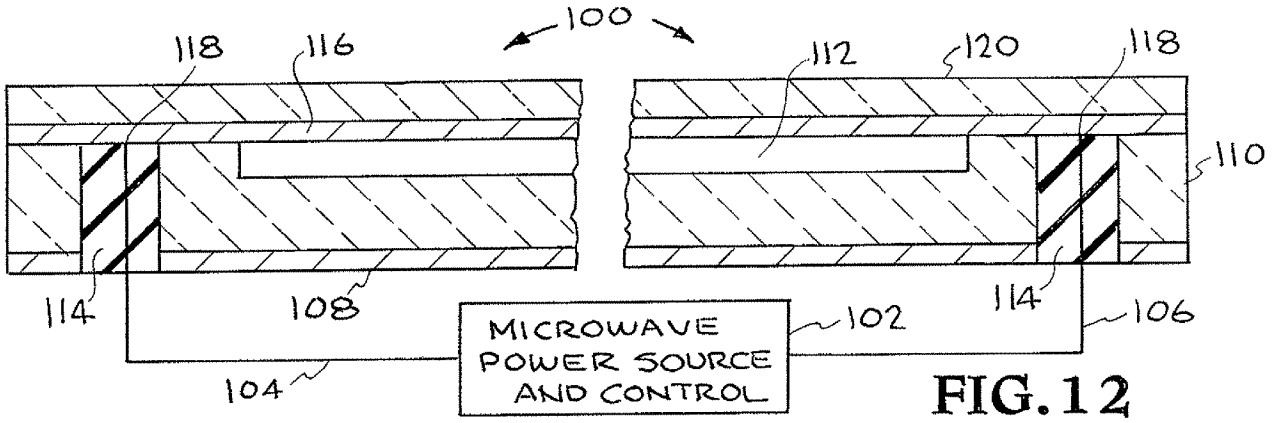
FIG. 12 provides additional details of the embodiment shown in FIG. 10.
Figure 13:
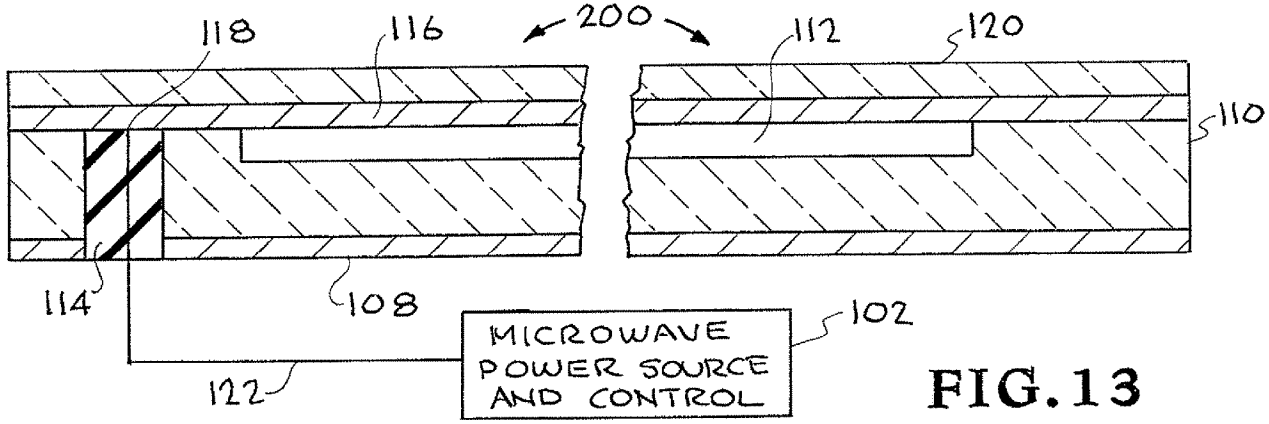
FIG. 13 provides additional details of the embodiment shown in FIG. 11.

Referring now FIGS. 12 and 13, additional details of two embodiments of systems 100 and 200 constructed in accordance with the present invention are illustrated. Additional details of the system 100 are illustrated in FIG. 12 which is a graphical cross sectional view of the circuit shown in FIG. 10. The items shown in FIG. 12 are similarly numbered as FIG. 10. Additional details of the system 200 are illustrated in FIG. 13 which is a graphical cross sectional view of the circuit shown in FIG. 11. The items shown in FIG. 13 are similarly numbered as FIG. 11.

Figure 14:
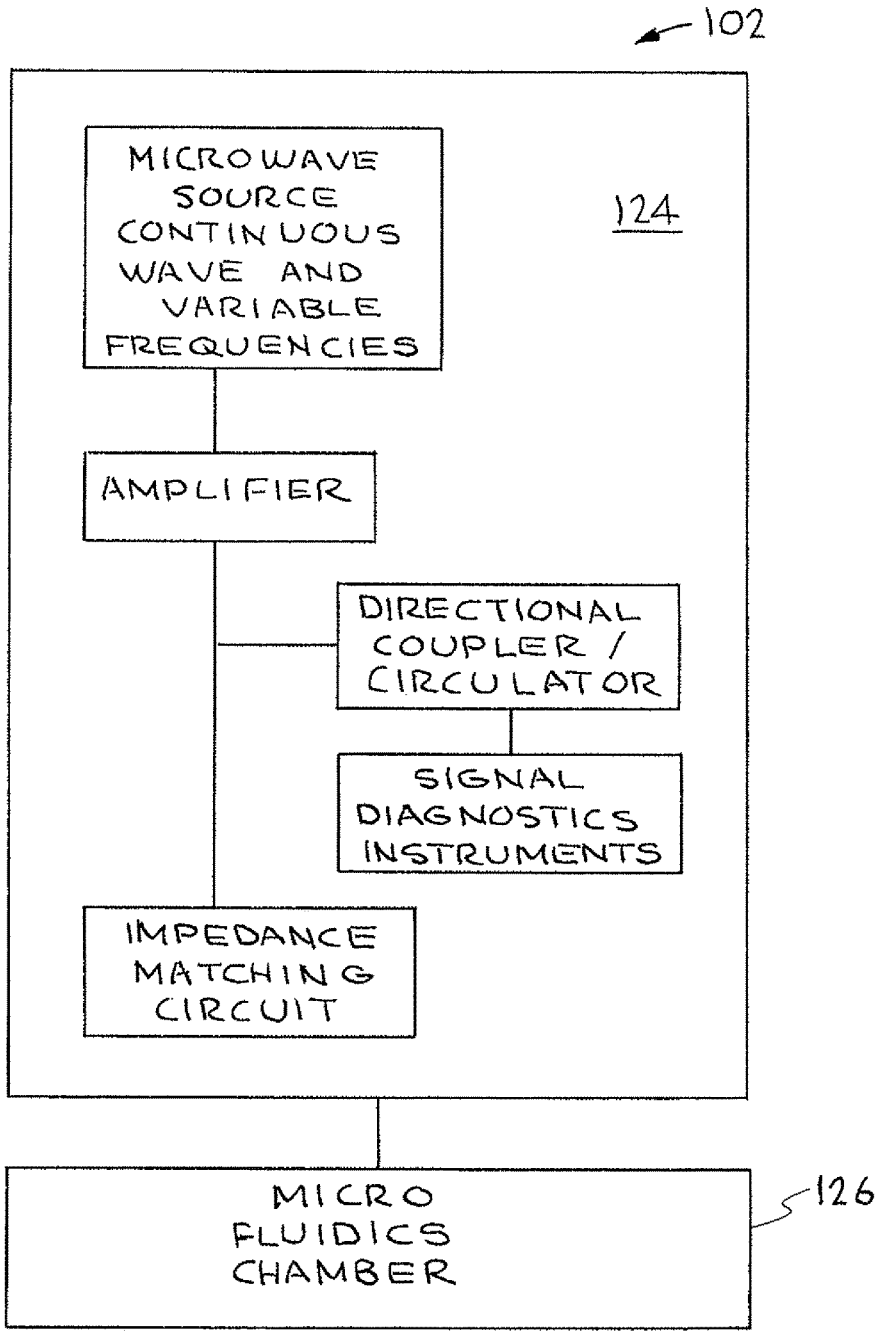
FIG. 14 provide additional details of the systems shown in FIGS. 10 thru 13.
Figure 15:
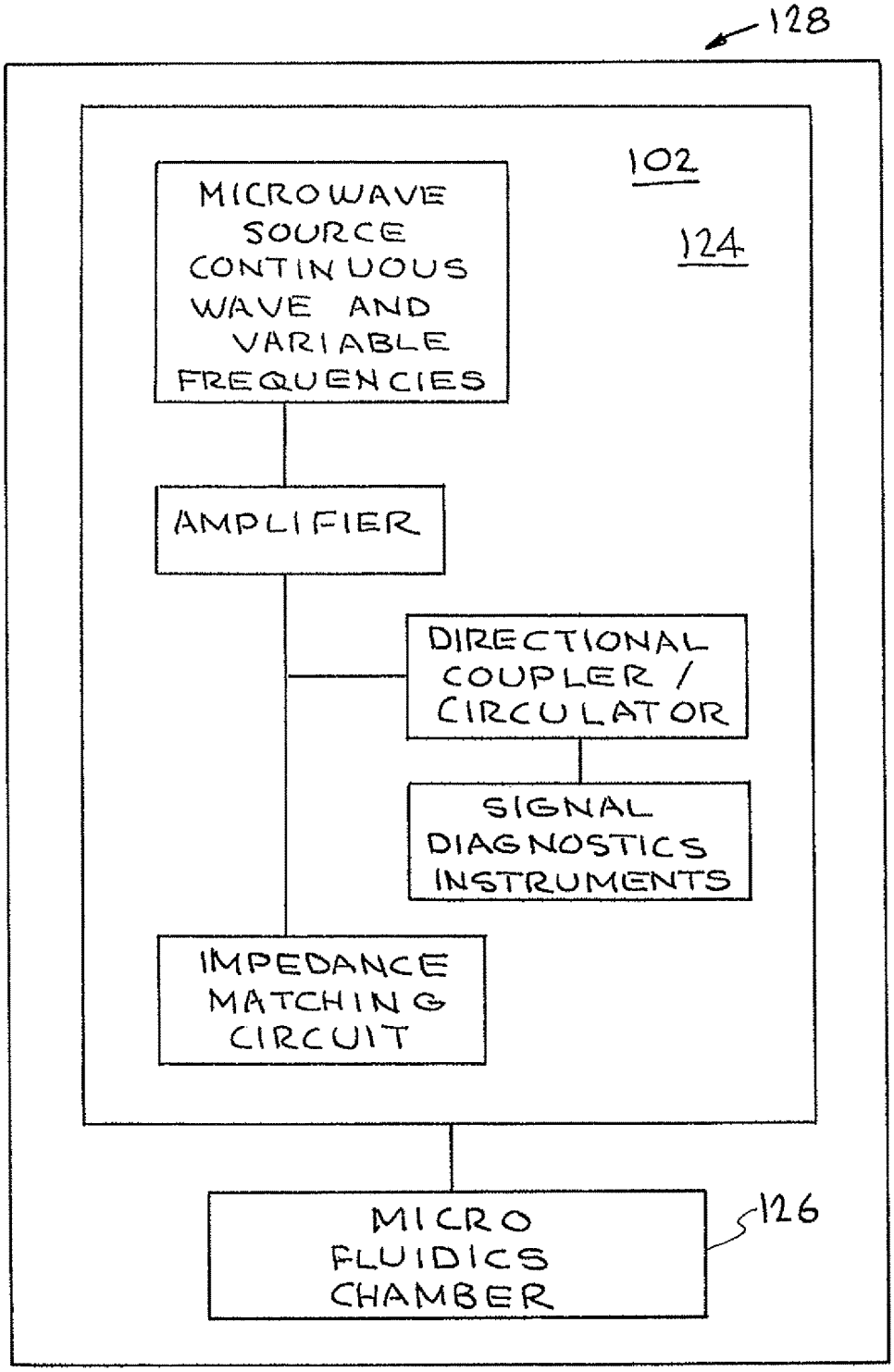
FIG. 15 provide additional details of the systems shown in FIGS. 10 thru 13.

Referring now to FIG. 14, a microwave power source and control unit 102 and micro fluidics chamber 126 are shown as separate units. Referring now to FIG. 15, a Monolithic Microwave Integrated Circuit (MMIC) device is shown where the integrated circuit 120 of microwave power source and control 102 and the micro fluidics chamber 126 are integrated as one unit on microchip 128.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A micro-electro-mechanical system apparatus for heating a sample, comprising:

a silicon substrate having a planar surface, a single straight linear co-planar micro-channel flow channel in said silicon substrate extending from said planar surface into said silicon substrate, a micro-droplet containing the sample wherein said micro-droplet is within said single straight micro-channel flow channel in said silicon substrate, an oil carrier fluid within said single straight micro-channel flow channel in said silicon substrate for moving said micro-droplet containing the sample in said single straight micro-channel flow channel wherein the sample and said oil carrier fluid produce microreactors in said single straight micro-channel flow channel with the sample surrounded by said oil carrier fluid in said micro-reactors, a glass cover over said single straight micro-channel flow channel, a first conductive co-planar strip on said solid silicon substrate proximate and parallel to said single straight micro-channel flow channel in said silicon substrate wherein said first conductive co-planar strip is a conductive Indium Tin Oxide strip, a second conductive co-planar strip on said solid silicon substrate proximate and parallel to said single straight micro-channel flow channel in said silicon substrate wherein said second conductive co-planar strip is a conductive Indium Tin Oxide strip, and a microwave power source and control connected to said first conductive co-planar strip and said second co-planar conductive strip which provides a microwave source that directs 18 to 26 GHz microwaves of electromagnetic radiation onto said silicon substrate and onto the sample and onto said oil carrier fluid in said single straight micro-channel flow channel in said silicon substrate for heating the sample.

2. A micro-electro-mechanical apparatus for heating a sample, comprising:

a silicon substrate having a planar surface, a single straight linear co-planar micro-channel flow channel in said silicon substrate extending from said planar surface into said one piece solid silicon substrate, a micro-droplet containing the sample wherein said micro-droplet is within said single straight linear co-planar micro-channel flow channel in said silicon substrate, a droplet maker that produces said micro-droplet containing the sample wherein said droplet maker introduces said micro-droplet containing the sample into said single straight linear co-planar micro-channel flow channel, an oil carrier fluid within said single straight linear co-planar micro-channel flow channel in said silicon substrate for moving said micro-droplet containing the sample in said single straight linear co-planar micro-channel flow channel, a glass cover over said micro-channel flow channel, a first conductive Indium Tin Oxide strip on said solid silicon substrate proximate and parallel to said single straight linear co-planar micro-channel flow channel in said silicon substrate, a second conductive Indium Tin Oxide strip positioned on said silicon substrate proximate and parallel to said single straight linear co-planar micro-channel flow channel in said silicon substrate, and a microwave power source and control connected to said first conductive Indium Tin Oxide strip and connected to said second conductive Indium Tin Oxide strip, said microwave power source and control producing 18 to 26 GHz microwaves that are directed onto said one piece solid silicon substrate and to the sample in said oil carrier fluid within said single straight linear co-planar micro-channel flow channel in said silicon substrate for heating the sample.

3. A micro-electro-mechanical apparatus for heating a sample, comprising:

a silicon substrate having a planar surface, a single straight linear co-planar micro-channel flow channel in said silicon substrate extending from said planar surface into said silicon substrate wherein said single straight linear co-planar micro-channel flow channel is 60 μm wide and 300 μm deep, a micro-droplet containing the sample wherein said micro-droplet is within said single straight linear co-planar micro-channel flow channel in said silicon substrate;

a droplet maker that produces said micro-droplet containing the sample wherein said droplet maker introduces said micro-droplet containing the sample into said single straight linear co-planar micro-channel flow channel;

a carrier fluid within said single straight linear co-planar micro-channel flow channel in said silicon substrate for moving said micro-droplet containing the sample in said single straight linear co-planar micro-channel flow channel;

a glass cover over said single straight linear co-planar micro-channel flow channel, a first conductive co-planar strip on said silicon substrate proximate and parallel to said single straight linear co-planar micro-channel flow channel in said silicon substrate wherein said first conductive co-planar strip is a conductive Indium Tin Oxide strip, a second conductive co-planar strip on said solid silicon substrate proximate and parallel to said single straight linear co-planar micro-channel flow channel in said silicon substrate wherein said second conductive co-planar strip is a conductive Indium Tin Oxide strip, and a microwave power source and control connected to said first conductive co-planar strip and said second co-planar conductive strip which provides a microwave source that directs microwaves of electromagnetic radiation onto said micro-droplet containing the sample, the sample, said silicone substrate, and said carrier fluid in said single straight linear co-planar micro-channel flow channel in said silicone substrate for heating the sample, wherein said microwave source and control is a microwave source and control that produces said microwaves.

* * * * *